US009902510B2

(12) United States Patent
Ponten

(10) Patent No.: US 9,902,510 B2
(45) Date of Patent: Feb. 27, 2018

(54) DEVICE AND METHOD FOR PACKAGING PRODUCTS IN A FOIL DEVICE, PACKAGE PRODUCED AND FILLED USING THE METHOD

(71) Applicant: PMB-UVA INTERNATIONAL B.V., Eindhoven (NL)

(72) Inventor: Marius Petrus Jozef Johannes Robertus Ponten, Eindhoven (NL)

(73) Assignee: PMB-UVA INTERNATIONAL B.V., Eindhoven (NL)

( * ) Notice: Subject to any disclaimer, the term of this patent is extended or adjusted under 35 U.S.C. 154(b) by 0 days.

(21) Appl. No.: 14/914,575

(22) PCT Filed: Aug. 26, 2014

(86) PCT No.: PCT/NL2014/050576
§ 371 (c)(1),
(2) Date: Feb. 25, 2016

(87) PCT Pub. No.: WO2015/030581
PCT Pub. Date: Mar. 5, 2015

(65) Prior Publication Data

US 2016/0200465 A1 Jul. 14, 2016

(30) Foreign Application Priority Data

Aug. 28, 2013 (NL) ..... 2011350

(51) Int. Cl.
*B65B 9/20* (2012.01)
*B65D 75/44* (2006.01)
(Continued)

(52) U.S. Cl.
CPC ..... *B65B 9/2014* (2013.01); *B65B 61/188* (2013.01); *B65D 31/10* (2013.01);
(Continued)

(58) Field of Classification Search
CPC .... B65D 31/10; B65D 33/24; B65D 33/2508; B65D 33/2516; B65D 33/2533;
(Continued)

(56) References Cited

U.S. PATENT DOCUMENTS 4,332,344 A * 6/1982 Strodthoff ..... B65D 33/2508 24/DIG. 50
6,820,391 B2 * 11/2004 Barmore ..... B65B 61/188 493/114

(Continued)

FOREIGN PATENT DOCUMENTS

EP 2364838 9/2011
WO 2010/089634 8/2010

*Primary Examiner* — Peter Helvey
(74) *Attorney, Agent, or Firm* — Casimir Jones S.C.; Tyler J. Sisk

(57) ABSTRACT

The present invention provides a device for packaging products in a foil package. The device comprises corner forming means for forming a number of folded and attached-together sections of foil material in a foil web, which sections extend outwardly in the longitudinal direction of the foil web, which sections each form a seam on the inner side of the foil web, packaging means, and transport means for transporting the foil web from a supply roll along the corner forming means and along the packaging means, respectively. The device further comprises application means for applying elongate closing elements perpendicular to the longitudinal direction of the web to the inner side of the web, wherein the application means are provided between the corner forming means and the shaping means and are adapted to apply the elongate closing elements such that the closing elements cross at least some of the seams formed in the foil web by the corner forming means.

5 Claims, 3 Drawing Sheets

Figure 1:
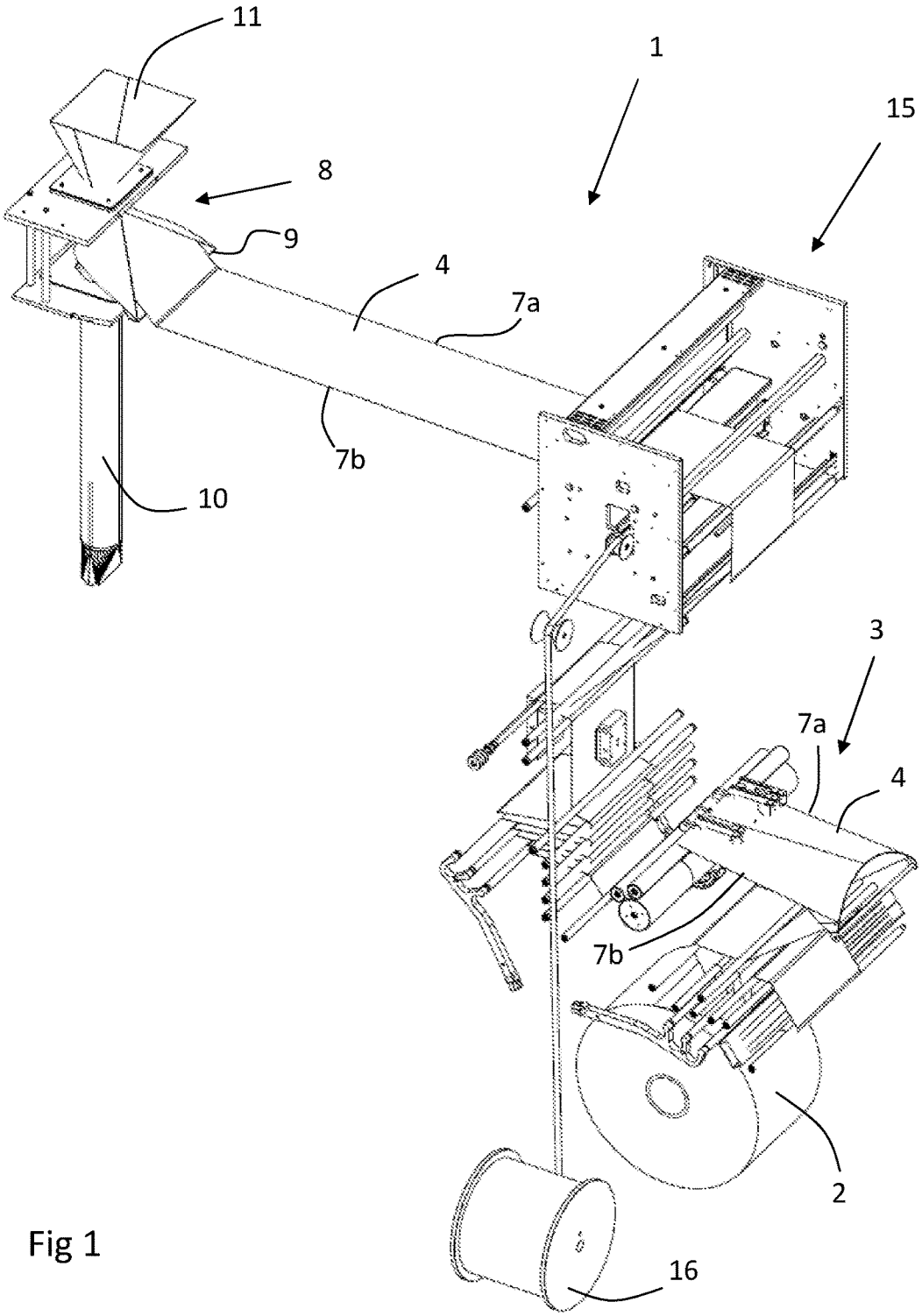

(51) Int. Cl.

| | |
|---|---|
| ***B65D 75/52*** | (2006.01) |
| ***B65B 61/18*** | (2006.01) |
| ***B65D 30/20*** | (2006.01) |
| ***B65D 33/25*** | (2006.01) |
| ***B65D 33/24*** | (2006.01) |
| *B31B 70/81* | (2017.01) |

(52) U.S. Cl.
CPC ..... *B65D 33/24* (2013.01); *B65D 33/2508* (2013.01); *B65D 33/2516* (2013.01); *B65D 33/2533* (2013.01); *B65D 33/2566* (2013.01); *B65D 75/44* (2013.01); *B65D 75/52* (2013.01); *B31B 70/8123* (2017.08)

(58) Field of Classification Search
CPC .... B65D 33/2566; B65D 75/44; B65D 75/52; B65B 61/188; B31B 70/8123
USPC ..... 383/93, 120; 493/267
See application file for complete search history.

(56) References Cited

U.S. PATENT DOCUMENTS

2001/0051008 A1* 12/2001 Wedi ..... B65D 33/2533 383/63
2002/0168120 A1* 11/2002 Wessling ..... B65D 31/10 383/95
2004/0208402 A1* 10/2004 Yeager ..... B65D 33/2533 383/120
2007/0086683 A1* 4/2007 Yeager ..... B65D 31/10 383/95
2008/0205801 A1* 8/2008 Alaux ..... B65D 31/10 383/120
2008/0240622 A1* 10/2008 Bell ..... B65D 31/10 383/5
2008/0240626 A1* 10/2008 Bell ..... B65D 31/10 383/120
2009/0136163 A1* 5/2009 Kerr ..... B65D 31/10 383/120
2010/0183249 A1* 7/2010 Wedi ..... B65D 33/2591 383/120
2010/0202714 A1* 8/2010 Koenigkramer ..... B65D 31/10 383/63
2011/0033133 A1* 2/2011 Kujat ..... B65D 31/10 383/20
2011/0077139 A1* 3/2011 Kujat ..... B31B 19/00 493/267
2011/0110612 A1* 5/2011 Nelson ..... B29C 70/54 383/42
2011/0268372 A1* 11/2011 Brauer ..... B65D 33/08 383/64
2011/0286688 A1* 11/2011 Gum ..... B65D 31/10 383/64
2012/0195532 A1* 8/2012 Koesters ..... B65D 31/10 383/120
2012/0207412 A1* 8/2012 Moehlenbrock ..... B31B 1/00 383/105
2012/0224794 A1* 9/2012 Veder ..... B65D 33/18 383/120
2014/0185966 A1* 7/2014 Umenaka ..... B65D 31/10 383/120
2015/0023614 A1* 1/2015 Cobler ..... B65D 75/5833 383/7
2015/0030265 A1* 1/2015 Stoeppelmann ..... B31B 37/00 383/109
2015/0049965 A1* 2/2015 Gum ..... B65D 75/563 383/120
2015/0125097 A1* 5/2015 Kenmotsu ..... B65D 75/008 383/104
2015/0274392 A1* 10/2015 Pease ..... B65D 75/5877 383/10

* cited by examiner

DEVICE AND METHOD FOR PACKAGING PRODUCTS IN A FOIL DEVICE, PACKAGE PRODUCED AND FILLED USING THE METHOD

The present invention relates to a device for packaging products in a foil package, comprising corner forming means for forming a number of folded and attached-together sections of foil material in a foil web, which sections extend outwardly in the longitudinal direction of the foil web, which sections each form a seam on the inner side of the foil web, and, downstream of the corner forming means, packaging means provided with a tube-shaped forming element, with shaping means for shaping the foil web around the forming element into a tube shape, with sealing means for sealing the tube-shaped foil on the downstream side of the forming element for forming a sealed first side of a package yet to be filled and for forming a sealed second side of an already filled package below the package yet to be filled, wherein the first side and the second side of a package are positioned opposite each other, and with filling means for filling the tube-shaped foil web, which is sealed on the first side, with products via the inner side of the forming element, the device further comprising transport means for transporting the foil web from a supply roll along the corner forming means and along the packaging means, respectively. The inner side and the outer side of the foil web are determined by the inner side and the outer side, respectively, of the package which is produced from the foil web. A device as described in the introduction is described in the international patent application WO 2009/139618 A1. Using such a device it is possible to increase the stiffness of corner edges of foil packages produced by means of a form, fill and seal machine, at which locations the folded and attached-together sections of foil material, so-called corner seals, are provided, resulting in a package having increased shape stability.

It is also known with other packages which are produced using a form, fill and seal machine to make use of elongate closing elements which are provided to the web foil material in a direction perpendicular to the longitudinal direction of the form, fill and seal machine, and with which it is possible to reclose a package after opening thereof by pressing together opposite sides of an opening in the package, causing parts of the closing elements provided on opposite sides of the opening to interlock and in this way close the opening. Such closing elements, also called reclosable strips, are available in many embodiments, wherein the parts of the closing elements present on opposite sides of the opening may be similar to each other or different from each other. This means that in the latter case two different closing elements are used for each package. Examples of closing elements as well as of devices with which closing elements can be provided to the foil web are described in the European publication EP 726665 A1 and EP 970804 A1. Closing elements as can be used in the present invention are marketed by the companies Zip Pak, Slide-Rite or Aplix using the names of Slider, Press-to-Close, PerfCap or Easy-Lock.

The present invention aims at providing a device as described in the introduction, with which it is possible to produce packages with corner seals, which packages are moreover provided with closing elements for the reclosure of a package which has been opened. To this end the device further comprises application means for applying elongate closing elements perpendicular to the longitudinal direction of the web to the inner side of the web, wherein the application means are provided between the corner forming means and the shaping means and are adapted to apply the elongate closing elements such that the closing elements cross at least some of the seams. Since the closing elements are only applied after the corner seals have been formed when the device according to the invention is used, the forming of the corner seals is not complicated by the presence of the closing elements, which would have been the case if the closing elements would have been applied to a fully flat foil web as this is known from the prior art. Consequently it is possible to reliably make corner seals on the one hand and nevertheless make use of closing elements on the other hand.

The invention also relates to a method for packaging products in a foil package using a device according to the invention as described above. The method according to the invention comprises the steps of a transporting a foil web along the corner forming means and the transport means, respectively, b forming a number of folded and attached-together sections of foil material, which extend outwardly in the longitudinal direction of the foil web, in the foil web, using the corner forming means, which sections each form a seam on the inner side of the foil web, c forming the foil web into a tube shape around the forming element, using the shaping means, d sealing the tube-shaped foil web on the downstream side of the forming element, using the sealing means, for forming a first sealed side of a package yet to be filled and for forming a second sealed side of a package which has already been filled below the package yet to be filled, wherein the first side and the second side of a package are positioned opposite each other, e filling the tube-shaped foil web, which is sealed on the first side, with products via the inner side of the forming element, f applying at least one elongate closing element for each package to the inner side of the foil web, perpendicular to the longitudinal direction of the web, using the application means, after step b and before step c, wherein the elongate closing elements cross at least some of the seams.

The advantages obtained by using the method according to the invention correspond to the advantages which have been described above related to the device according to the invention.

Preferably, at least one elongate closing element is applied to the inner side of the foil web for each package during step f, preferably such that the at least one elongate closing element crosses no more and no less than two seams. This way it is possible to produce a package with a spout opening which can be folded out and which is reclosable using the at least one closing element in question. This way a package of the spout zip type is obtained.

According to an alternative preferred embodiment, at least one elongate closing element is applied to the inner side of the foil web for each package during step f, such that the at least one elongate closing element extends over the full width or almost the full width of the foil web, crossing all seams. The reclosable opening which can be obtained in the package using such a method extends over the full width of the package, the width of the package being oriented perpendicular to the longitudinal direction of the foil web from which the package is provided.

The invention finally also relates to a package produced and filled using a method according to the invention as discussed above. Such a package combines the advantages of corner seals and closing elements. Since the corner seals are already attached before the closing elements are applied, the closing elements do not extend on the inner side of the folded and attached-together sections of foil material. More specifically the invention provides a package produced and filled using a method according to the invention as elucidated above, wherein the package is formed from a foil web and comprises a number of folded and attached-together sections of foil material, which extend outwardly in the longitudinal direction of the foil web, which sections each form a seam on the inner side of the package and wherein the package further comprises a elongate closing element which is attached to the inner side of the package perpendicular to the longitudinal direction of the sections foil material, wherein the closing element crosses at least some of the seams.

Figure 2A:
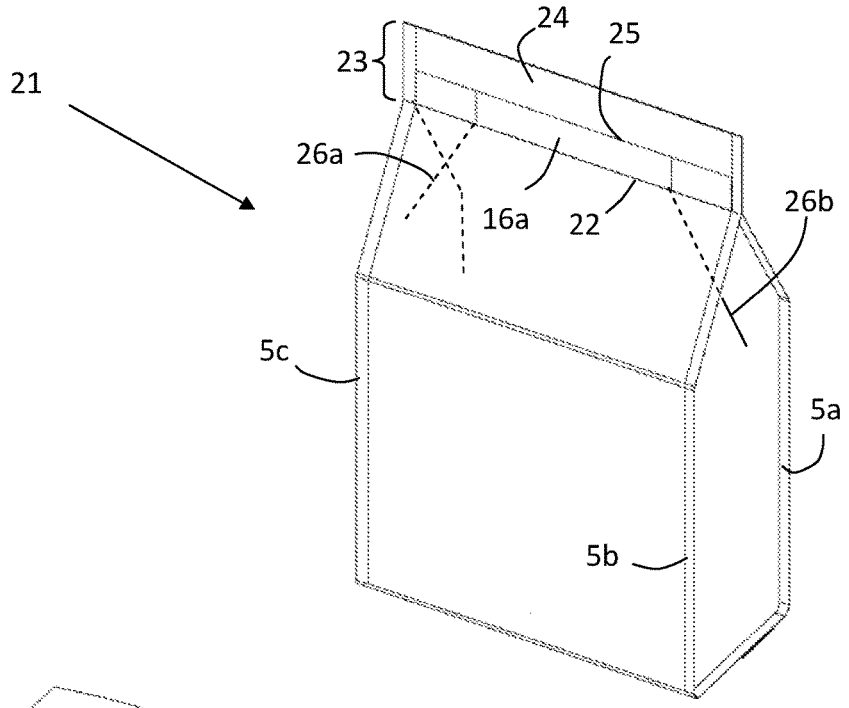
Figure 2B:
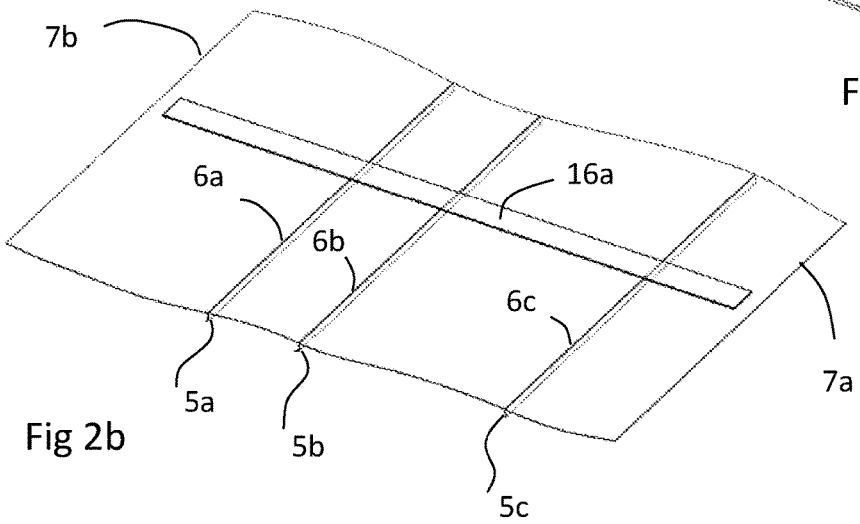

The invention will now be further elucidated by means of the description of a preferred embodiment of the invention, which is not to be interpreted as limiting, with reference to the following figures:

FIG. 1 is an isometric view of parts of a packaging device according to the invention which are relevant to the invention;

FIGS. 2*a* and 2*b* respectively show a first embodiment of a foil package which can be produced using the invention, as well as a part of the foil web as used for producing the package according to FIG. 2*a;*

Figure 3A:
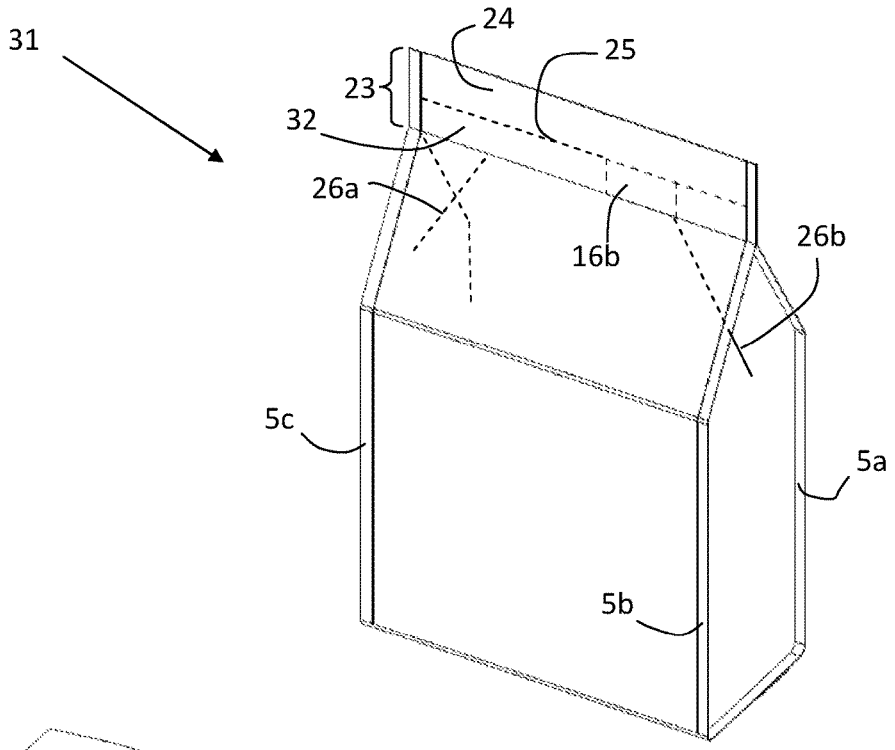
Figure 3B:
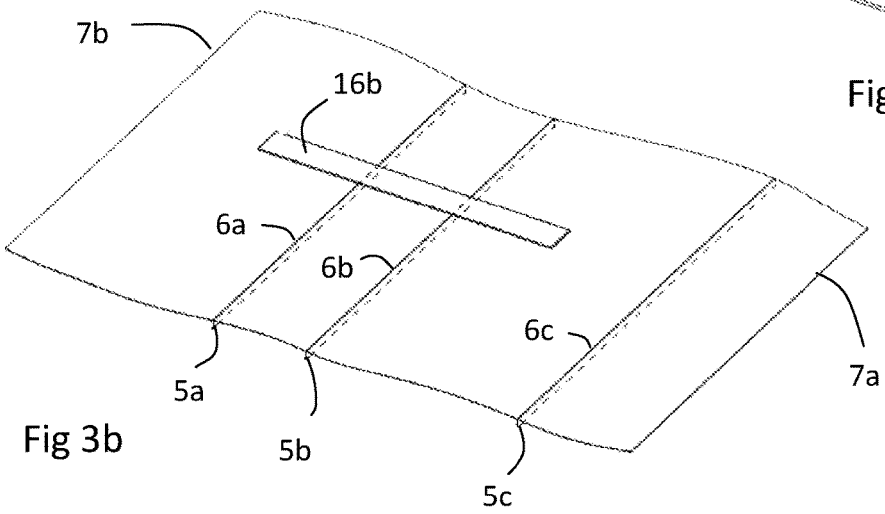

FIGS. 3*a* and 3*b* respectively show a second embodiment of a foil package which can be produced using the invention, as well as a part of the foil web as used for producing the package according to FIG. 3*a*.

FIG. 1 shows parts of a packaging device 1 which is capable of making foil packages from a foil web which is unwound from roll 2. Packaging device 1 comprises a corner forming unit 3 which is adapted to form a number of folded and attached-together sections of foil material, which extend outwardly in the longitudinal direction of the foil web in foil web 4 being unwound from roll 2. These sections are also indicated as corner seals 5. Such corner seals 5 are indicated by reference numbers 5*a*, 5*b*, 5*c* and 6*a*, 6*b*, 6*c* in FIGS. 2*a* to 3*b*. The corner seals 5*a*-5*c* are not shown in the foil web 4 in FIG. 1. The corner seals 5 extend parallel to the opposite longitudinal edges 7*a*, 7*b* of foil web 4 and each comprise a seam 6*a*, 6*b*, 6*c* which is located on the inner side of the foil web 4, the inner side of the foil web 4 being determined by the inner side of the package of the resulting foil package. For a more detailed description of the corner forming unit 3 reference is made to international application WO 2009/139618 A1, the contents of which are to be considered to be incorporated in the present description.

Packaging device 1 further comprises a packaging unit 8 downstream of the corner forming unit 3, which packaging unit 8 is well-known to the skilled person from several embodiments of so-called form, fill and seal machines. Packaging unit 8 inter alia comprises a shoulder element 9, a tube element 10 and a hopper 11. Using the shoulder element 9, the foil web 4 is formed into a tube shape which joins the circumference of the tube element 10, wherein the longitudinal edges 7*a*, 7*b* of the foil web overlap each other. On the outer side of tube element 10, packaging unit 8 comprises longitudinal sealing means at the location of this overlap, by means of which sealing means the foil web 4 is sealed together at the location of the longitudinal edges 7*a*, 7*b*, forming a fourth corner seal 5*d* (not shown), as it were.

For an alternative package, four corner seals 5*a*-5*d* can be formed in the corner forming unit 3, wherein said longitudinal sealing means form a simple longitudinal seal at the location of the overlapping longitudinal sedges 7*a*, 7*b*.

Below tube element 10, packaging unit 8 comprises transverse sealing means, which transverse sealing means press opposite sides of the tube shape against each other in order to obtain a closed bottom side of a package yet to be filled as well as a closed upper side of package which already has been filled. Filling of the packages takes place by feeding products to be packaged, via hopper 11 and the inner side of the tube element 10, to the foil web 4, which has been formed into a closed tube shape above the transverse sealing means.

Packaging device 1 further comprises an application unit 15 between corner forming unit 3 and packaging unit 8. Application unit 15 is adapted to connect elongate closing elements 16*a*, 16*b* (see FIGS. 2*b* and 3*b*) to the foil web 4, more specifically to the inner side thereof. This connection is such that the elongate closing elements 16*a*, 16*b* extend transverse to the longitudinal direction of the foil web and consequently transverse to the seams 6*a*, 6*b*, 6*c*, and that at least some of the seams 6*a*, 6*b*, 6*c* are crossed. In FIG. 2*b* all three corner seals 5*a*, 5*b*, 5*c* are crossed and closing element 16*a* extends almost the complete width of foil web 4. Only a relatively small area close to the longitudinal edges is left free. In this area the foil web 4 overlaps itself at the location of the longitudinal edges 7*a*, 7*b* when the fourth corner seal is made using the longitudinal sealing means as described above. Closing element 16*b* in FIG. 3*b* only crosses two seams 6*a*, 6*b*.

The closing elements can be of different types and are, just like application unit 15, as such known to the skilled person, and need not be described in detail herein, therefore. In this connection reference is made for example to publications EP 726665 A1 and EP 970840 A1. The closing elements are unwound from roll 16 and made in a desired length and connected to the foil web 5, for example by welding or glueing, in the application unit 15.

FIG. 2*a* shows a package 21 as can be made from a foil web 4 shown in FIG. 2*b*. Package 21 has a rectangular cross section over the largest part of the height thereof, wherein the corner seals 5*a*, 5*b*, 5*c,d* are positioned at the corners of the rectangle and provide a certain shape stability to the package 21. Close to the upper side of package 21, the sides of package 21 between corner seals as well as between corner seals 5*c* and 5*d* are folded inwardly according to lines 26*a*, 26*b* such that, seen in vertical cross-section, package 21 has a point 22 which is directed upwardly parallel to the side faces, which are folded inwardly. On the upper side of this point 22, package 21 comprises a flat sealing part 23 where corner seals 5*a*, 5*b* and corner seals 5*c*, 5*d* abut against each other. In the lower part of the sealing part 23, closing element 16*a* is provided, which closing element 16*a* has a (mirrored) W-shape close to the corner seals 5*a*, 5*b* on the one hand and close to the corner seals 5*c*, 5*d* on the other hand. In the upper part of sealing part 23 the upper side of package 21 is closed using transversal sealing means with seal 24. Opening package 21 for the first time is done by separating seal 24 from the remaining part of package 21, for example by or tearing cutting seal 24 loose along line 25. The opposite parts of closing element 16*a* can be pulled loose from each other thereafter causing the package 21 to be actually opened and that the packaged products can be taken from the package 21. Package 21 can be easily closed again by pressing the parts of the closing element 16*a* that originally abutted against each other together again.

Package 31 according to FIG. 3*a* differs from package 21 according to FIG. 2*a* in that a shorter closing element 16*b* is used. At the location in the lower part of sealing part 23 of package 21 where closing element 16*b* is not provided, a second seal 21 is provided, besides seal 24 which is provided in the upper part of the sealing part 23. Opening the package 31 for the first time takes place in the same way as for package 21, i.e. by making a separation along line 25. The opposite parts of closing element 16*b* can then be pulled apart, after which the inwardly folded upper part of the side of package 31 that extends between the corner seals 5*a* and 5*b* can be folded outward, thus creating a spout. This spout can serve as a pouring spout. The package 31 can subsequently be closed again by pressing together opposite parts of the closing element 16*b*, possibly after the respective side has been folded inwardly again.

Although the invention has been explained above by means of a description of a preferred embodiment in which the tube element 10 is oriented vertically, it is also possible within the framework of the present invention that the tube element is oriented horizontally or obliquely.

The invention claimed is:

1. A device for packaging products in a foil package, comprising:

a corner forming means for forming a number of folded and attached-together sections of a foil material in a foil web, which sections extend outwardly in the longitudinal direction of the foil web, which sections each form a seam on the inner side of the foil web;

packaging means downstream of the corner forming means provided with a tube-shaped forming element, comprising shaping means for shaping the foil web around the forming element into a tube shape, further comprising sealing means for sealing the tube-shaped foil on the downstream side of the forming element for forming a sealed first side of a yet to be filled package and for forming a sealed second side of an already filled package below the yet to be filled package, wherein the first side and the second side of a package are positioned opposite each other, and further comprising filling means for filling the tube-shaped foil web, which is sealed on the first side, with products via the inner side of the forming element;

transport means for transporting the foil web from a supply roll along the corner forming means and along the packaging means, respectively; and application means for applying elongate closing elements perpendicular to the longitudinal direction of the web to the inner side of the web, wherein the application means are provided between the corner forming means and the shaping means and are adapted to apply the elongate closing elements such that the closing elements cross at least some of the seams.

2. A method for packaging products in a foil package using a device according to claim 1 comprising the steps of:

a. transporting a foil web along the corner forming means and the transport means;

b. forming a number of folded and attached-together sections of foil material, which extend outwardly in the longitudinal direction of the foil web, in the foil web, using the corner forming means, which sections each form a seam on the inner side of the foil web;

c. forming the foil web into a tube shape around the forming element, using the shaping means;

d. sealing the tube-shaped foil web on the downstream side of the forming element, using the sealing means, for forming a first sealed side of a package yet to be filled and for forming a second sealed side of a package which has already been filled below the package yet to be filled, wherein the first side and the second side of a package are positioned opposite each other;

e. filling the tube-shaped foil web, which is sealed on the first side, with products via the inner side of the forming element; and f. applying at least one elongate closing element for each package to the inner side of the foil web, perpendicular to the longitudinal direction of the web, using the application means, after step (b) and before step (c), wherein the elongate closing elements cross at least some of the seams.

3. A method according to claim 2, wherein at least one elongate closing element is applied to the inner side of the foil web for each package during step (f) such that the at least one elongate closing element crosses no more and no less than two seams.

4. A method according to claim 2, wherein at least one elongate closing element is applied to the inner side of the foil web for each package during step (f) such that the at least one elongate closing element extends over the full width or almost the full width of the foil web crossing all seams.

5. A package produced and filled according to a method of claim 2, wherein the package is formed from a foil web and comprises a number of folded and attached-together sections of foil material, which extend outwardly in the longitudinal direction of the foil web, which sections each form a seam on the inner side of the package and wherein the package further comprises a elongate closing element which is attached to the inner side of the package perpendicular to the longitudinal direction of the sections foil material, wherein the closing element crosses at least some of the seams.

* * * * *